US008275294B2

(12) United States Patent
Ikeda et al.

(10) Patent No.: US 8,275,294 B2
(45) Date of Patent: Sep. 25, 2012

(54) DEVELOPING DEVICE AND IMAGE FORMING APPARATUS

(75) Inventors: Masashi Ikeda, Minamiashigara (JP); Manabu Furuki, Minamiashigara (JP); Masahiro Uchida, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 731 days.

(21) Appl. No.: 12/251,166

(22) Filed: Oct. 14, 2008

(65) Prior Publication Data

US 2009/0214265 A1 Aug. 27, 2009

(30) Foreign Application Priority Data

Feb. 21, 2008 (JP) ..... 2008-039928

(51) Int. Cl.
*G03G 15/08* (2006.01)

(52) U.S. Cl. ..... 399/254; 399/258

(58) Field of Classification Search ..... 399/254–260
See application file for complete search history.

(56) References Cited

U.S. PATENT DOCUMENTS

| | | | | |
|---|---|---|---|---|
| 5,012,285 | A * | 4/1991 | Oka et al. | 399/260 |
| 2002/0075513 | A1 | 6/2002 | Yogome et al. | |
| 2007/0253720 | A1 * | 11/2007 | Kasai | 399/27 |

FOREIGN PATENT DOCUMENTS

| | | |
|---|---|---|
| JP | A 2000-19822 | 1/2000 |
| JP | A-2001-353938 | 12/2001 |
| JP | A-2002-287496 | 10/2002 |
| JP | A-2007-003865 | 1/2007 |
| JP | A-2007-206453 | 8/2007 |
| KR | 10 2004 0018866 A | 3/2004 |

OTHER PUBLICATIONS

Jun. 26, 2012 Office Action issued in Korean Patent Application No. 10 2008 0116118 (with translation).
Jul. 17, 2012 Office Action issued in Japanese Patent Application No. 2008-039928 (with translation).

* cited by examiner

*Primary Examiner* — Walter L Lindsay, Jr.
*Assistant Examiner* — Roy Y Yi
(74) *Attorney, Agent, or Firm* — Oliff & Berridge, PLC

(57) ABSTRACT

A developing device includes: a container that contains a developer including toner; a partition that forms a plurality of chambers by partitioning an interior space of the container; an agitation mechanism that agitates the developer in the interior space and moves the developer between the plurality of chambers; a transport section that is supplied with the developer from the container, and transports the developer to a surface of an image carrier that carries an electrostatic latent image such that the transported developer is close to or contacts the surface of the image carrier, thereby developing the electrostatic latent image; and a driving mechanism that moves at least the partition.

23 Claims, 11 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2008-39928 filed Feb. 21, 2008.

BACKGROUND (i) Technical Field

The present invention relates to a developing device that develops an electrostatic latent image with a developer including toner and to an image forming apparatus provided with the developing device.

(ii) Related Art

Conventionally, there has been known an image forming apparatuses in which an electrostatic latent image is formed on a surface of an image carrier such as a photoreceptor and is developed with a developer including toner and a magnetic carrier, i.e., charging particles that charge the toner by friction between the magnetic carrier and the toner. The obtained developed image is transferred and fixed onto a sheet, thereby obtaining an image of the fixed image formed on the sheet.

Some of the image forming apparatuses have a developing device provided with a container that contains a developer with toner and a magnetic carrier and a development roll that carries the developer in the container on the surface thereof while rotating. In such a developing device, an agitator provided in the container agitates the developer, which causes friction between the toner and the magnetic carrier. As a result, the toner is charged with a certain polarity while the magnetic carrier is charged with a polarity opposite to that of the toner. Thus, in the developer, the toner is electrostatically attached to the magnetic carrier.

In addition, some of the developing devices are adapted to have a container partitioned into a first chamber and a second chamber and to move and agitate a developer between the first chamber adjacent to a development roll and the second chamber adjacent to the first container.

In such a developing device having a partitioned container, a developer attached to the partition gradually become larger to form lumps and may suddenly collapse due to its tare weight or vibration.

However, the lumped developer attached to the partition includes large amount of toners that have insufficient electrostatic charge due to insufficient agitation in the developer. Thus, sudden collapse of the developer may lead to degraded image quality.

SUMMARY

According to one aspect of a developing device of the present invention, there is provided a first developing device that includes: a container that contains a developer including toner; a partition that forms a plurality of chambers by partitioning an interior space of the container; an agitation mechanism that agitates the developer in the interior space and moves the developer between the plurality of chambers; a transport section that is supplied with the developer from the container, and transports the developer to a surface of an image carrier that carries an electrostatic latent image such that the transported developer is close to or contacts the surface of the image carrier, thereby developing the electrostatic latent image; and a driving mechanism that moves at least the partition.

BRIEF DESCRIPTION OF THE DRAWINGS

Exemplary embodiments of the present invention will be described in detail based on the following figures, wherein.

DETAILED DESCRIPTION

Figure 1:
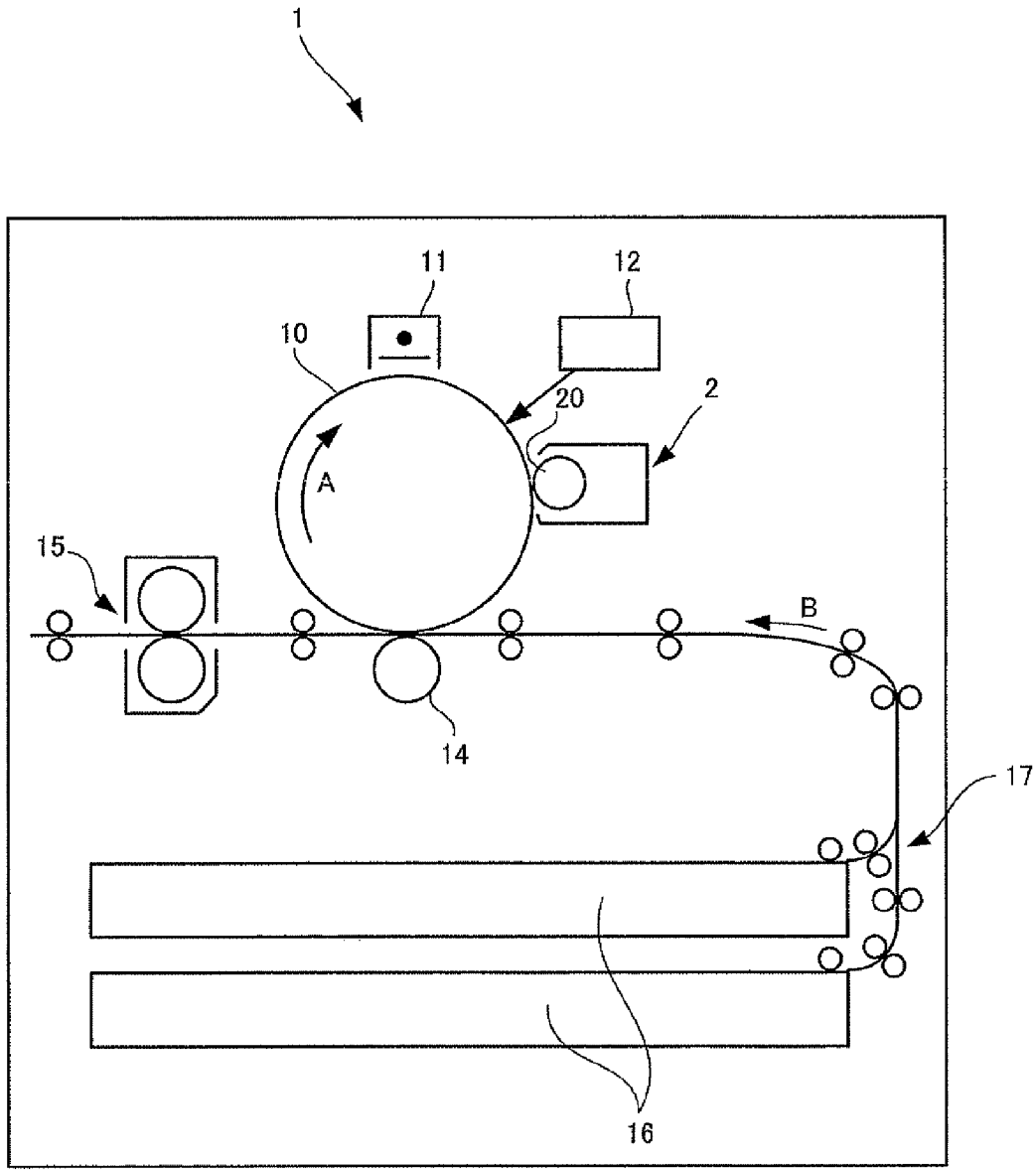
FIG. 1 is a schematic diagram of an image forming apparatus.

FIG. 1 is a schematic diagram of an image forming apparatus.

An image forming apparatus 1 shown in FIG. 1 includes: an image carrier 10 that carries an image on a surface thereof and rotates in a direction indicated by the arrow A; a charging unit 11 that imparts an electric charge to a surface of the image carrier 10; an exposure unit 12 that generates an exposure light based on image data transmitted from the outside; a developing device 2 that contains a developer including toner and a magnetic carrier; a paper tray 16 that stores sheets of recording paper; a paper conveyance unit 17 that pulls a sheet of recording paper out from the paper tray 16 to convey; a transfer roll 14 that transfers a toner image on the surface of the image carrier 10 onto the sheet of recording paper conveyed in the direction indicated by the arrow B; and a fuser 15 that heats and fixes the toner image onto the sheet. In addition, the developing device 2 has a developing roll 20 that rotates facing the image carrier 10, and the developer contained in the developing device 2 includes toner and a magnetic carrier that is a charging particle attracted by a magnet and that charges toner by rubbing against the toner.

In the image forming apparatus 1 shown in FIG. 1, the exposure unit 12 irradiates an electrically-charged surface of the image carrier 10 with an exposure light based on the image data, which forms a latent image on the surface of the image carrier 10. A developer contained in the developing device 2 is supplied to the surface of the developing roll 20, which will be described later in detail, and to a developing area between the image carrier 10 and the developing roll 20. The latent image formed on the surface of the image carrier 10 is developed by toner included in the supplied developer and is formed into a toner image. The toner image is transferred by the transfer roll 14 onto a sheet of recording paper conveyed in the direction of the arrow B. The transferred image is then heated and pressed by the fuser 15 to be fixed onto the sheet. This completes an image forming process. The image forming apparatus 1 is a first exemplary embodiment of the image forming apparatus according to the present invention, which is provided with a first exemplary embodiment of the developing device of the present invention.

Figure 2:
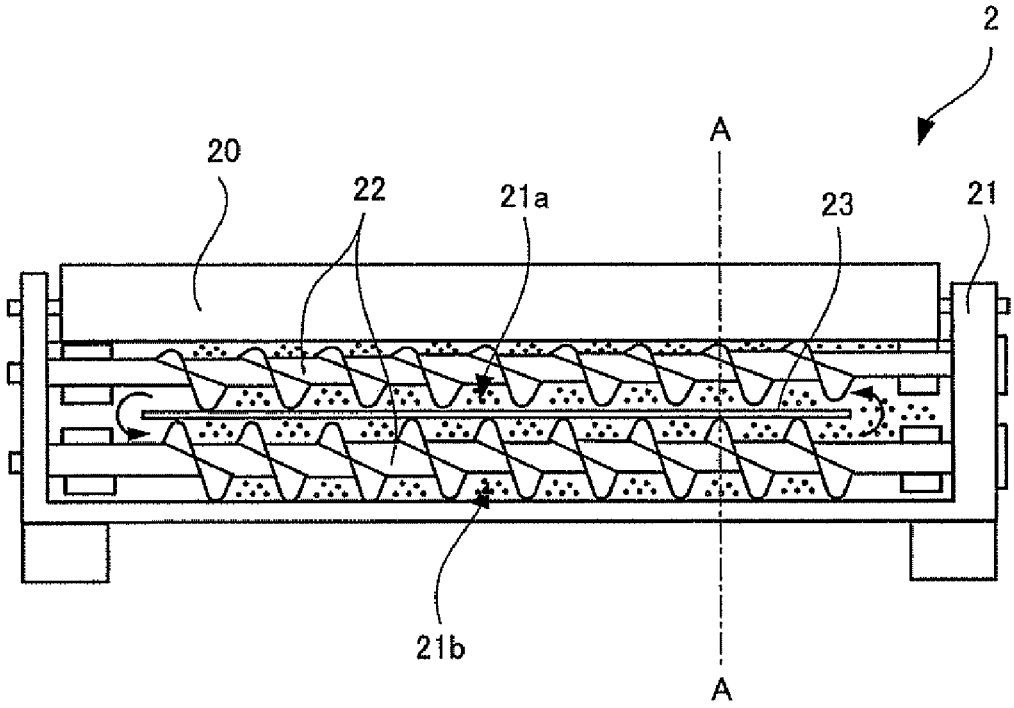
FIG. 2 is a detail diagram of a developing device shown in FIG. 1.
Figure 3:
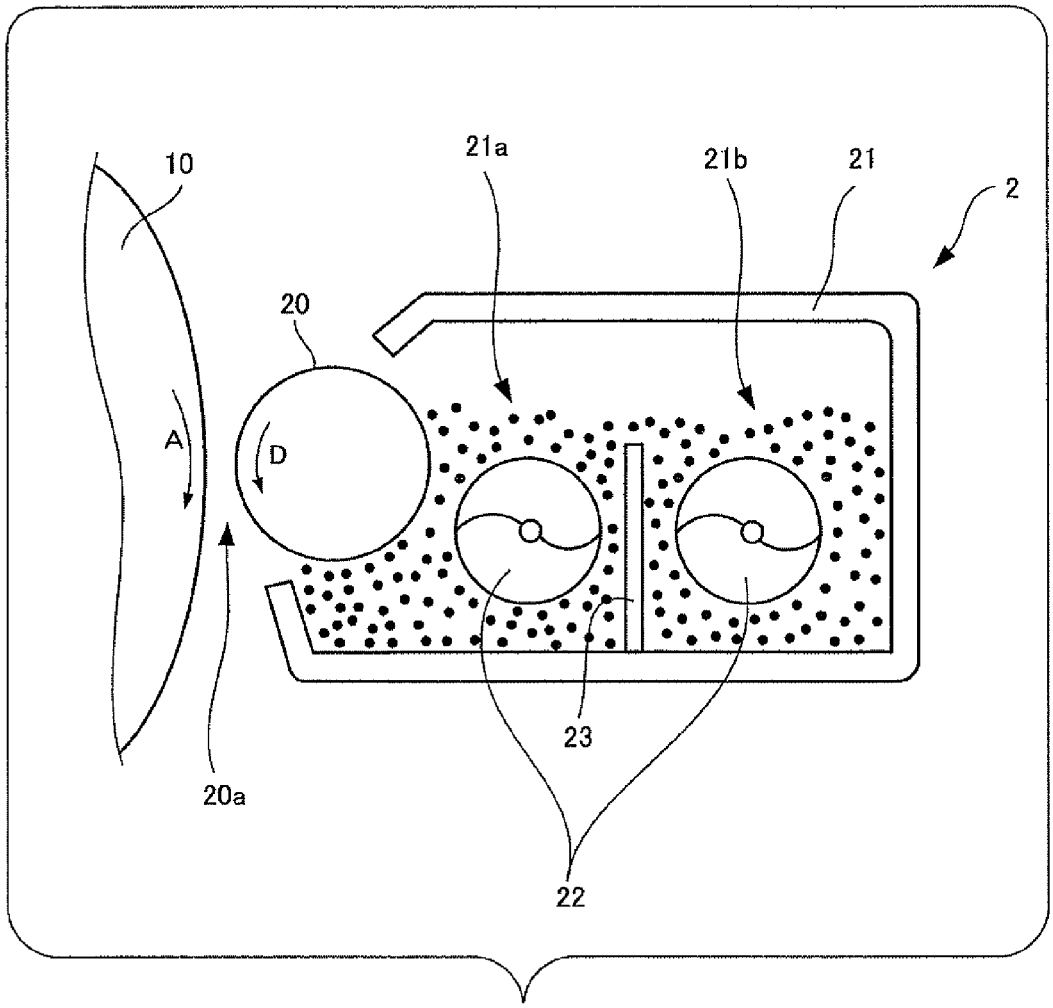
FIG. 3 is a detail diagram of the developing device shown in FIG. 1.

FIG. 2 and FIG. 3 are detail diagrams of the developing device 2 shown in FIG. 1.

FIG. 2 shows a perspective view of the developing device 2 as viewed from the above, and FIG. 3 shows a cross-sectional view of the same taken along the line A-A indicated in FIG. 2.

The developing device 2 shown FIG. 2 and FIG. 3 has the developing roll 20, agitation members 22, a partition board 23, a container 21, and is adapted to contain and agitate a developer including toner and a magnetic carrier and supply the toner in agitated developer to the developing roll 20.

The developing roll 20 is shaped like a cylinder and rotates in the development area 20*a* facing the image carrier 10 in the direction in which the circumference surface of the developing roll 20 moves downward.

The container 21 is made of resin and contains a developer. In addition, the container 21 supports both ends of the rotation shaft of the developing roll 20. The internal space of the container 21 is partitioned by the partition board 23 extending along the rotation shaft of the developing roll 20 into a first chamber 21*a* that supplies a developer to the surface of the developing roll 20 and a second chamber 21*b* that is adjacent to the first chamber 21*a* interposed by the partition plate 23.

The agitation members 22 are spiral and respectively disposed in the first and second chambers facing the directions opposite to each other. When the agitation members 22 are driven, the developer is agitated and moved toward the spiral central axis. This makes the developer circulate between the first chamber 21*a* and the second chamber 21*b*. Agitating developer causes friction between the toner and the magnetic carrier. As a result, the toner and magnetic carrier become charged to certain extent.

Although not shown, the developing roll 20 has a hollow developing sleeve that rotates in the direction indicated by the arrow D and a magnet roll that is disposed inside the developing sleeve and fixed independently of the developing sleeve. Incidentally, a predetermined voltage is applied to the developing roll 20 to cause potential difference between the developing roll 20 and the latent image formed on the surface of the image carrier 10.

The developer is attracted to the magnet roll inside the developing sleeve and thereby is supplied to the rotating developing sleeve, which in return supplies the developer to the development area 20*a* between the image carrier 10 and the development sleeve. Toner component of the developer supplied to the development area 20*a* by the developing roll 20 is separated from the magnetic carrier to be attached to the electrostatic latent image formed on the image carrier 10, due to potential difference between the electrostatic latent image and the developing roll 20. This is how a toner image is formed on the surface of the image carrier 10.

Figure 4A:
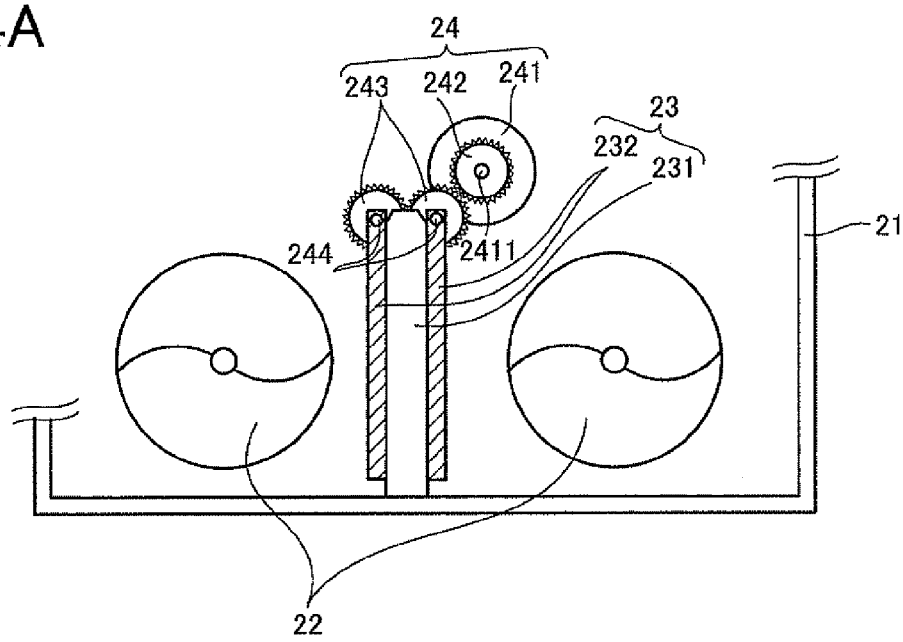
FIG. 4A and FIG. 4B are detail diagrams of a partition portion of the developing device shown in FIG. 2 and FIG. 3.
Figure 4B:
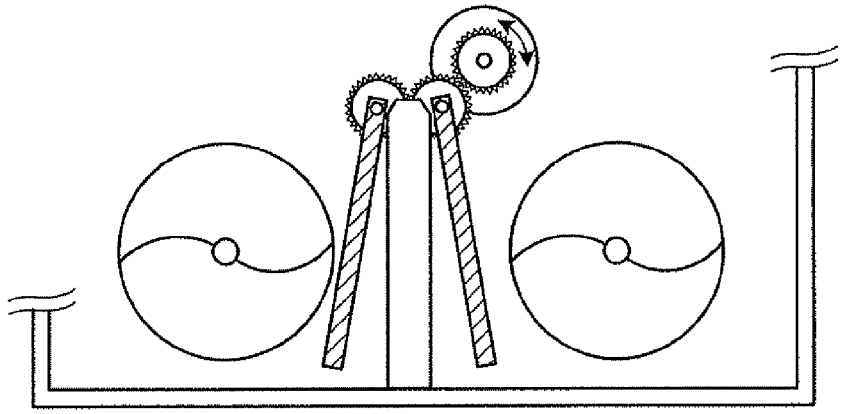

As described above, the developing device 2 is provided with the two agitating members 22 that are each disposed in the first chamber 21*a* and second chamber 21*b* of the container 21 to agitate the developer and cause the friction between the magnetic carrier and toner. As a result, the toner is charged sufficiently to develop the electrostatic latent image. However, when the developer attached to the partition board 23 gradually becomes larger to form lumps, the toner contained in the lumped developer is deemed to have few chances to rub against the magnetic carrier and thus have low charge. Accordingly, the toner may suddenly collapse due to its tare weight or vibration and lead to degraded image quality. In this regard, a countermeasure is contrived in the developing device 2 to prevent developer attached to the partition board 23 from forming lumps FIG. 4A and FIG. 4B are detail diagrams of the partition board 23 shown in FIGS. 2 and 3.

The partition board 23 has a fixed portion 231 and a driven portion 232. Although not shown in FIG. 3, a driving section 24 to drive the driven portion 232 is provided in the developing device 2 and has a stepping motor 241, a pinion gear 242, gears 243, and shafts 244.

The fixed portion 231 is fixed to a base of the container 21. The driven portions 232 are made of resin and have a size and a width smaller than the fixed portion 231. The metal shafts 244 are embedded respectively in the ends of the two driven portions 232 and extend from the front side to the depths side in FIG. 4 (in the longitudinal direction of the partition board 23). The both ends of the shaft 244 are supported by the container 21 so as to be rotatable. The driven portions 232 hang from the shaft 244 along the front and rear surfaces of the fixed portion 231 as shown in FIG. 4A.

The gears 243 are respectively attached to ends of the two shafts 244 and engaged with each other. One of the gears 243 is engaged with the pinion gear 242 attached to a rotation shaft 2411 of the stepping motor 241. Thus, driving the stepping motor 241 causes the two driven portions 232 to symmetrically open (see FIG. 4B) and close (see FIG. 4B) relative to the fixed portion 231. Accordingly, in the developing device 2 of the present exemplary embodiment, driving the stepping motor 241 appropriately to open and close the driven portions 232 relative to the fixed portion 231 shocks and loosens the developer attached to the driven portions 232.

Hereafter, exemplary embodiments of other developing devices will be described that, like the developing device 2, are capable of loosening lumped developer attached to a partition board in a developer container and are capable of replacing the developing device 2.

Figure 5A:
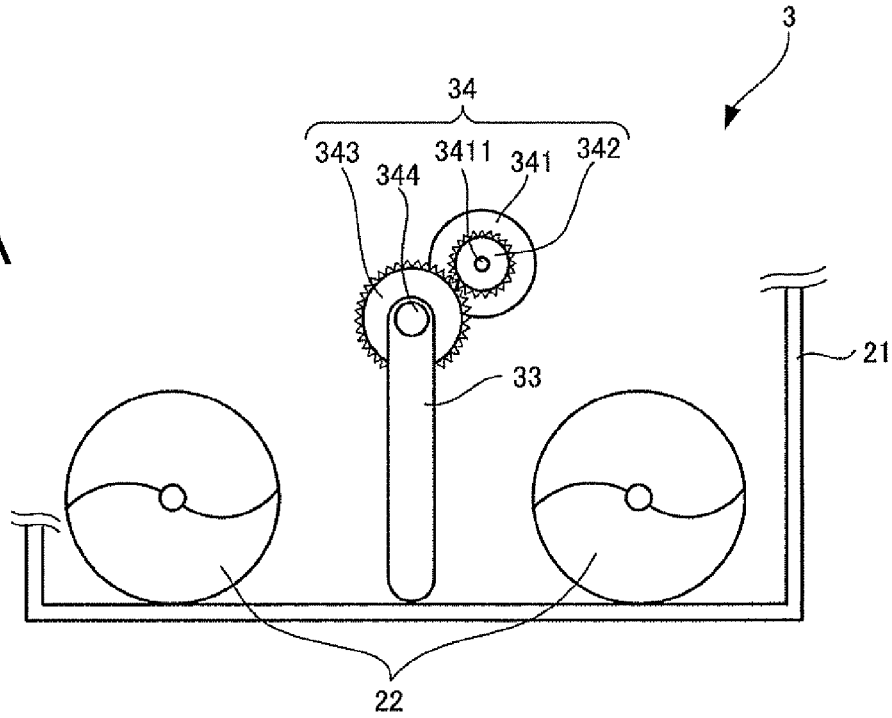
FIGS. 5A to 5C are detail diagrams of a partition portion of a developing device that is a second exemplary embodiment.
Figure 5B:
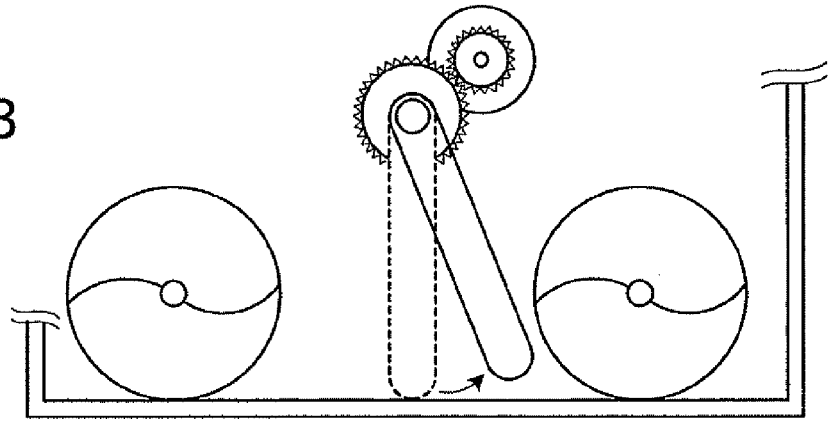
Figure 5C:
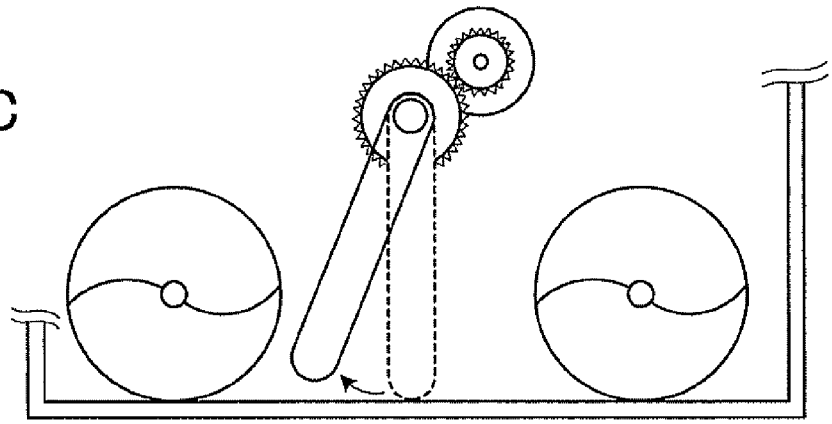

FIGS. 5A-5C are detail diagrams of a partition board of a developing device that is a second exemplary embodiment. It should be noted that, in the following description, components having the same functions as those of the above-described components in FIGS. 2 and 3 are denoted by the same reference characters.

A partition board 33 of a developing device 3 is a simple board member made of resin. A driving section 34 to drive the partition board 33 is provided in the developing device 3 that is the second exemplary embodiment of the present invention.

The driving section 34 has a stepping motor 341, a pinion gear 342, a gear 343, and an axis 344.

The metal axis 344 extending from the front side to the depths side in FIG. 5 (in the longitudinal direction of the partition board 33) is embedded in an edge of the partition board 33. The ends of the axis 344 are rotatably supported by a container 21 such that the other edge of the partition board 33, which is opposite to the edge where the axis 344 is embedded, touches the base of the container 21 (see FIG. 5A).

The gear 343 is attached to the end of the axis 344. The gear 343 is engaged with the pinion gear 342 attached to a rotation shaft 3411 of the stepping motor 341. Thus, driving the stepping motor 341 causes the partition board 33 to swing to right and left around the axis 344 (see FIGS. 5B and 5C). Accordingly, also in the developing device 3, driving the stepping motor 341 as required enables loosening of developer attached to the partition board 33.

Figure 6A:
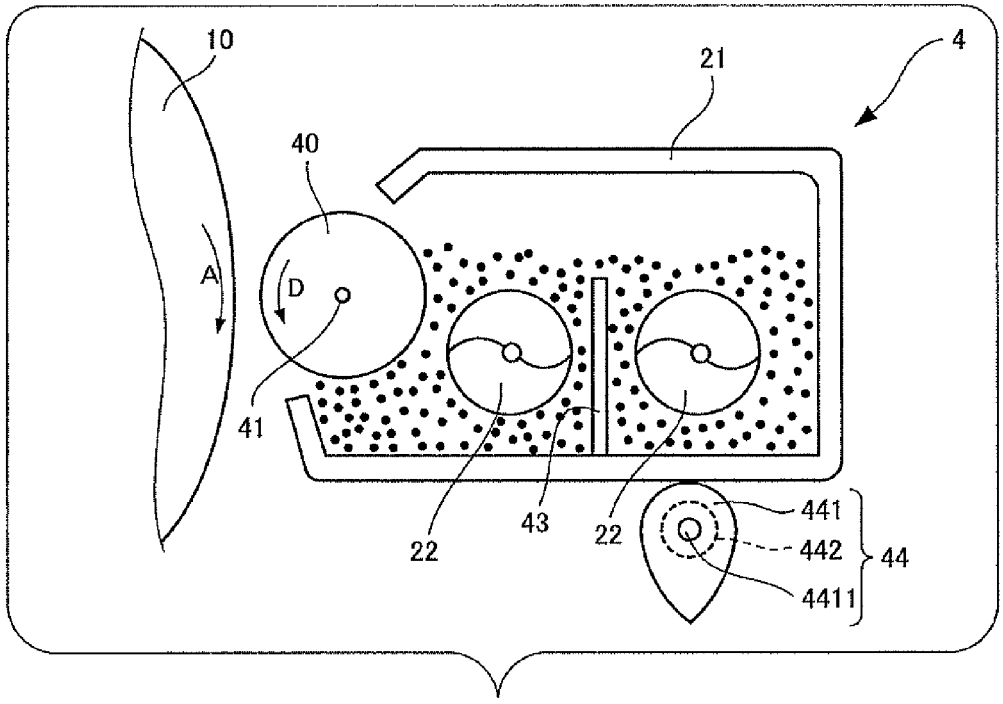
FIG. 6A and FIG. 6B are detail diagrams of a partition portion of a developing device that is a third exemplary embodiment.
Figure 6B:
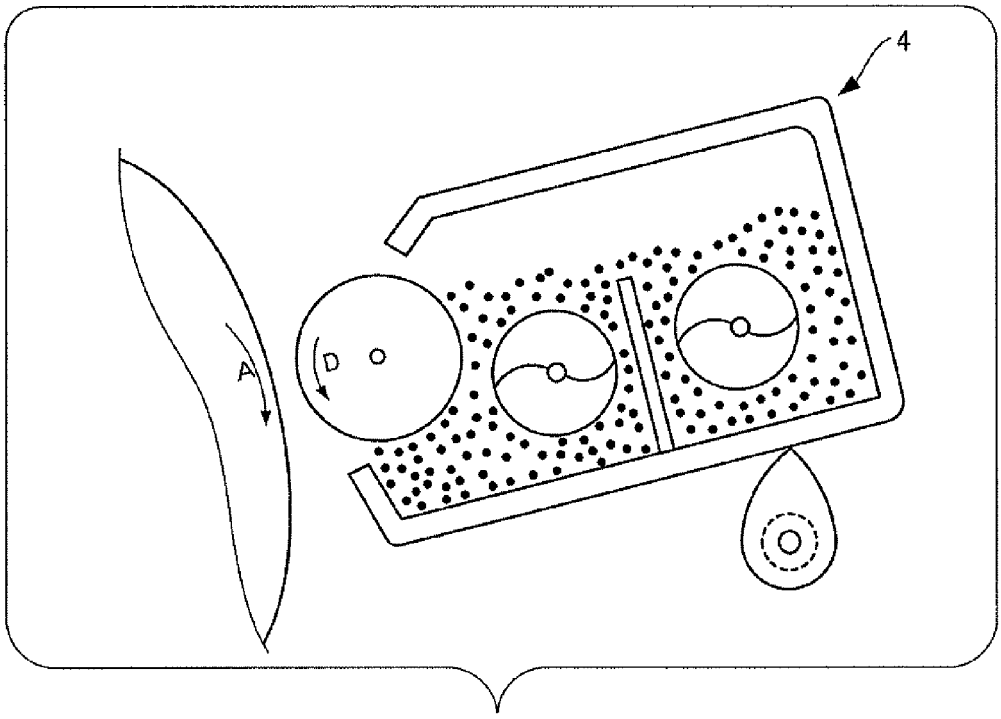

FIG. 6A and FIG. 6B are detail diagrams of a partition portion of a developing device that is a third exemplary embodiment.

In a developing device 4 shown in FIG. 6, both ends of a central axis 41 of a developing roll 40 pass through a container 21 and are supported by a frame (not shown) of an image forming apparatus 1. The container 21 to the base of which a partition board 43 is fixed is adapted to swing around the developing roll 40. The developing device 4 is a third exemplary embodiment of the present invention.

In addition, the developing device 4 is provided with a driving section 44 having a cam 441 that supports a bottom of the container 21 and a stepping motor 442 having a rotation shaft 4411 to which the cam 441 is attached. Driving the stepping motor 442 causes the container 21 to swing around the developing roll 40 (see FIG. 6B), and to return to a horizontal position (see FIG. 6A). Accordingly, also in the developing device 4, driving the stepping motor 441 as required to swing the container 21 enables loosening of developer attached to the partition board 43.

Figure 7A:
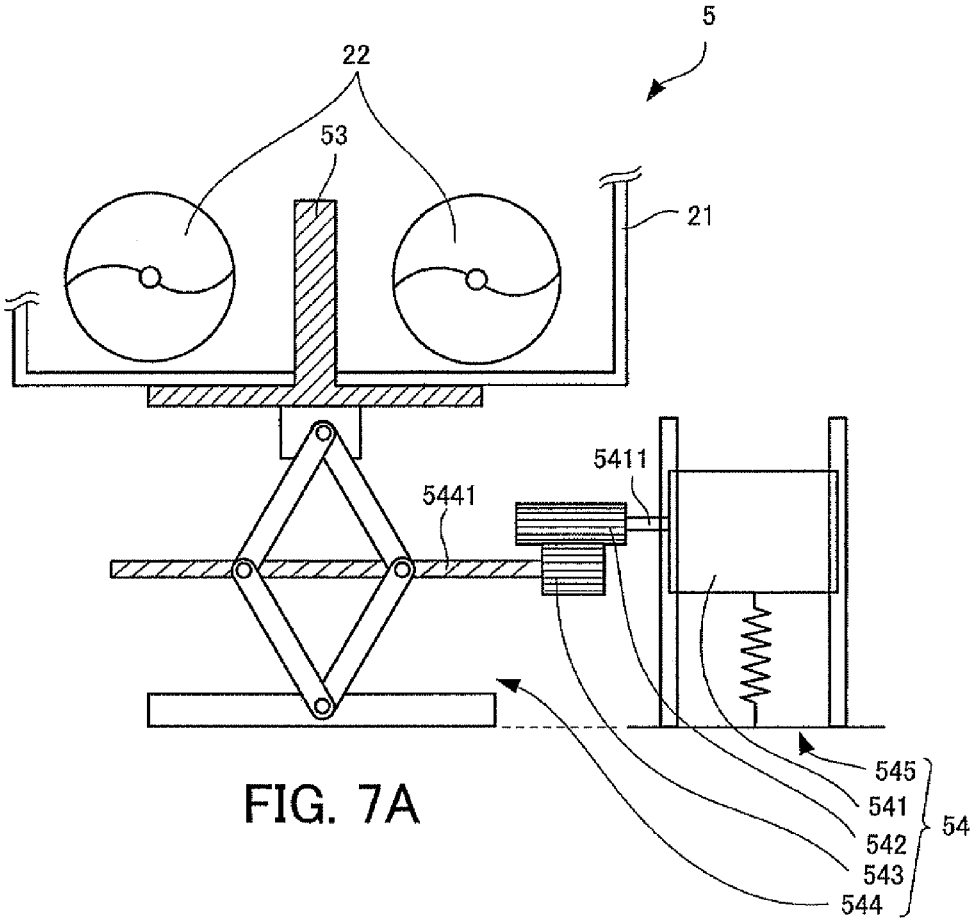
FIG. 7A and FIG. 7B are detail diagrams of a partition portion of a developing device that is a fourth exemplary embodiment.
Figure 7B:
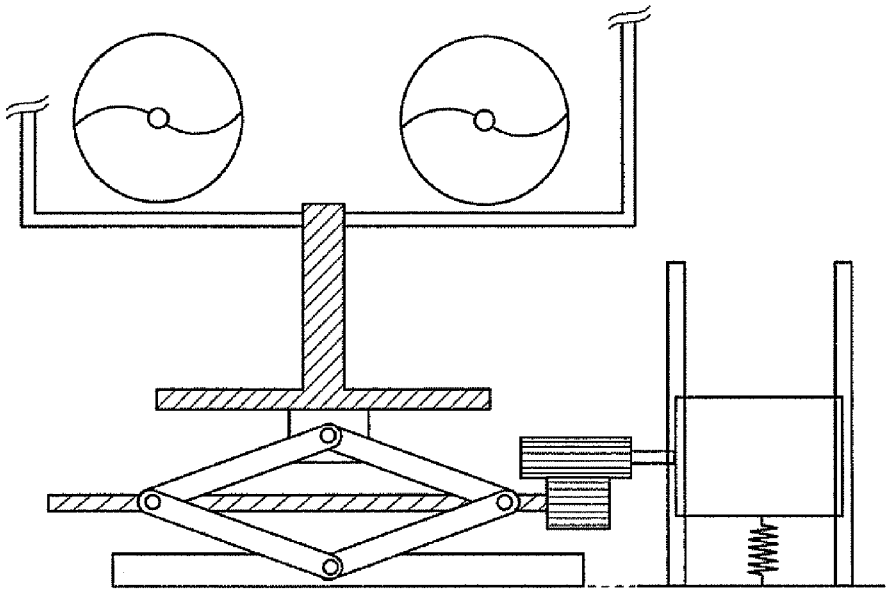

FIG. 7A and FIG. 7B are detail diagrams of a partition portion of a developing device that is a fourth exemplary embodiment.

A partition board 53 of a developing device 5 shown in FIG. 7A and FIG. 7B is a member whose section is shaped like a reverse T. A driving section 54 for driving the partition board 53 to move up and down relative to the container 21 is provided in the developing device 5 that is the fourth exemplary embodiment of the present invention.

The driving section 54 has a stepping motor 541, a pinion gear 542, a gear 543, a laboratory jack 544 for supporting the partition board 53 and a motor holding portion 545. An axis bar 5441 with a helical gash formed on its surface is pierced through the central portion of the jack 544 in the lateral direction in FIG. 7. Rotating the axis bar 5441 changes the form of the jack 544 and thereby changes a position of the jack 544 for supporting the partition board 53. As the laboratory jack 544 is a well-known device, further detailed description is omitted. The motor holding portion 545 serves to stabilize engagement of the pinion gear 542 with the gear 543 in response to a change of the supporting position of the laboratory jack 544.

The gear 543 is attached to an end of the axis bar 5441. The gear 543 is engaged with the pinion gear 542 attached to a rotation shaft 5411 of the stepping motor 541. Thus, driving the stepping motor 541 enables change in height (see FIG. 7A and FIG. 7B) of the partition board 53 relative to the container 21. Accordingly, also in the developing device 5, driving the stepping motor 541 as required to move the partition board 53 vertically relative to the container 21 enables loosening of developer attached to the partition board 53. It should be noted that the partition board 53 may be moved from the front side to the depths side or from the depth side to the front side in FIG. 7 (in the longitudinal direction of the partition board 53) rather than in the vertical direction relative to the container 21. Further, the partition board 53 may be moved in the lateral direction in FIG. 7 to the extent of not touching the agitation members 22.

Figure 8:
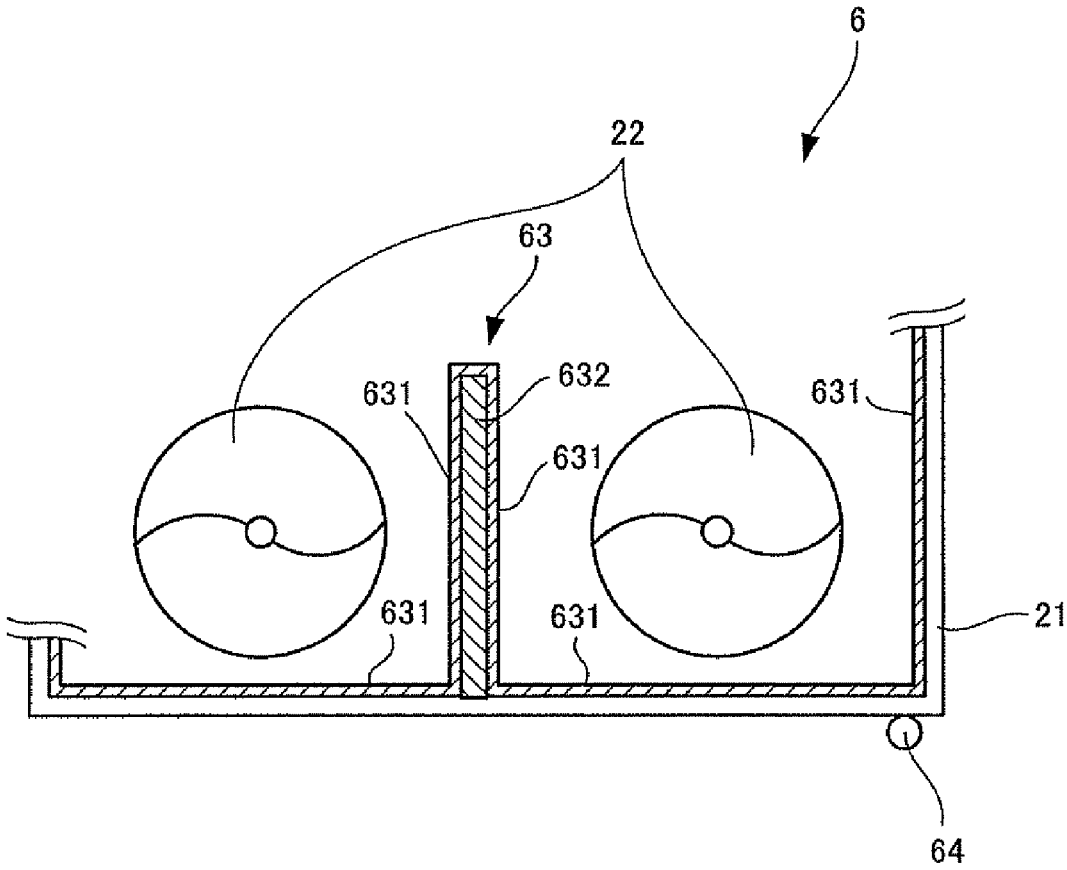
FIG. 8 is a detail diagram of a partition portion of a developing device that is a fifth exemplary embodiment.

FIG. 8 is a detail diagram of a partition portion of a developing device that is a fifth exemplary embodiment.

In a developing device 6 shown in FIG. 8, the interior of a resin-made container 21 is provided with a hard-rubber lining so that a lining layer 631 is formed inside the container 21. A core member 632 made of the same hard rubber as the lining layer 631 is fixed to a central portion of the base of the container 21 and also provided with a hard-rubber lining, thereby forming a partitioning elastic body 63 to separate an interior space of the container 21 into two areas. The developing device 6 is the fifth exemplary embodiment of the developing device according to the present invention.

The developing device 6 has an eccentric motor 64 that is driven to rotate for oscillating the container 21 and is fixed to the base of the container 21. Thus, driving the eccentric motor 64 oscillates the partitioning elastic body 63. Accordingly, also in the developing device 6, driving the eccentric motor 64 as required enables loosening of developer attached to the partitioning elastic body 63.

Figure 9:
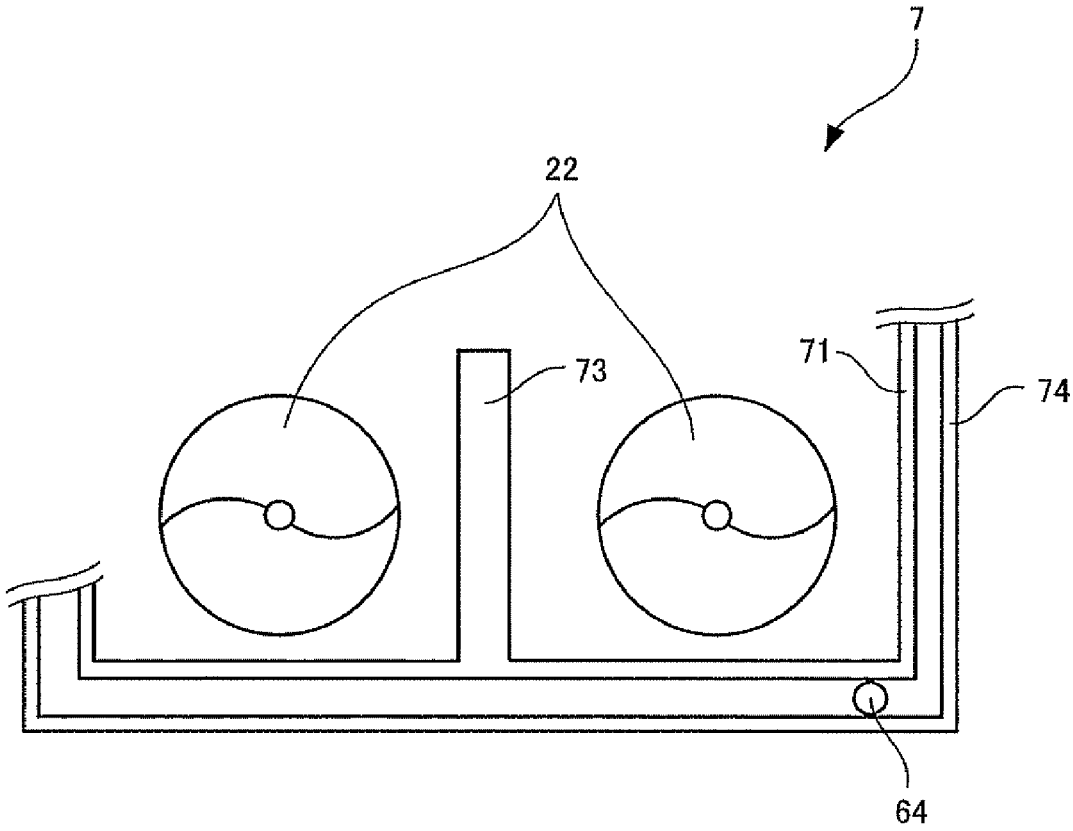
FIG. 9 is a detail diagram of a partition portion of a developing device that is a sixth exemplary embodiment.

FIG. 9 is a detail diagram of a partition portion of a developing device that is a sixth exemplary embodiment.

A developing device 7 shown in FIG. 9 has a hard-rubber container 71 having a partition section 73, an eccentric motor 64 fixed to the base of the container 71, and a housing 74 made of resin for encapsulating the container 71. With this structure, driving the eccentric motor 64 oscillates the container 71 and then the partition section 73. Accordingly, also in the developing device 7, driving the eccentric motor 64 as required enables loosening of developer attached to the partition section 73. The developing device 7 is the sixth exemplary embodiment of the developing device according to the present invention.

The above descriptions refer to the image forming apparatus 1 that is the first exemplary embodiment of the present invention, and to exemplary embodiments of the developing devices capable of being disposed in the image forming apparatus 1.

Hereafter, description will be made of a developing device that is a seventh exemplary embodiment of the developing device according to the present invention and is to be disposed in an image forming apparatus that is a second exemplary embodiment of the image forming apparatus according to the present invention. It should be noted that descriptions will focus on the developing device of the seventh exemplary embodiment. Descriptions of functions and external appearance of an image forming apparatus that is a second exemplary embodiment are omitted, as they are identical with those of the image forming apparatus 1.

Figure 10:
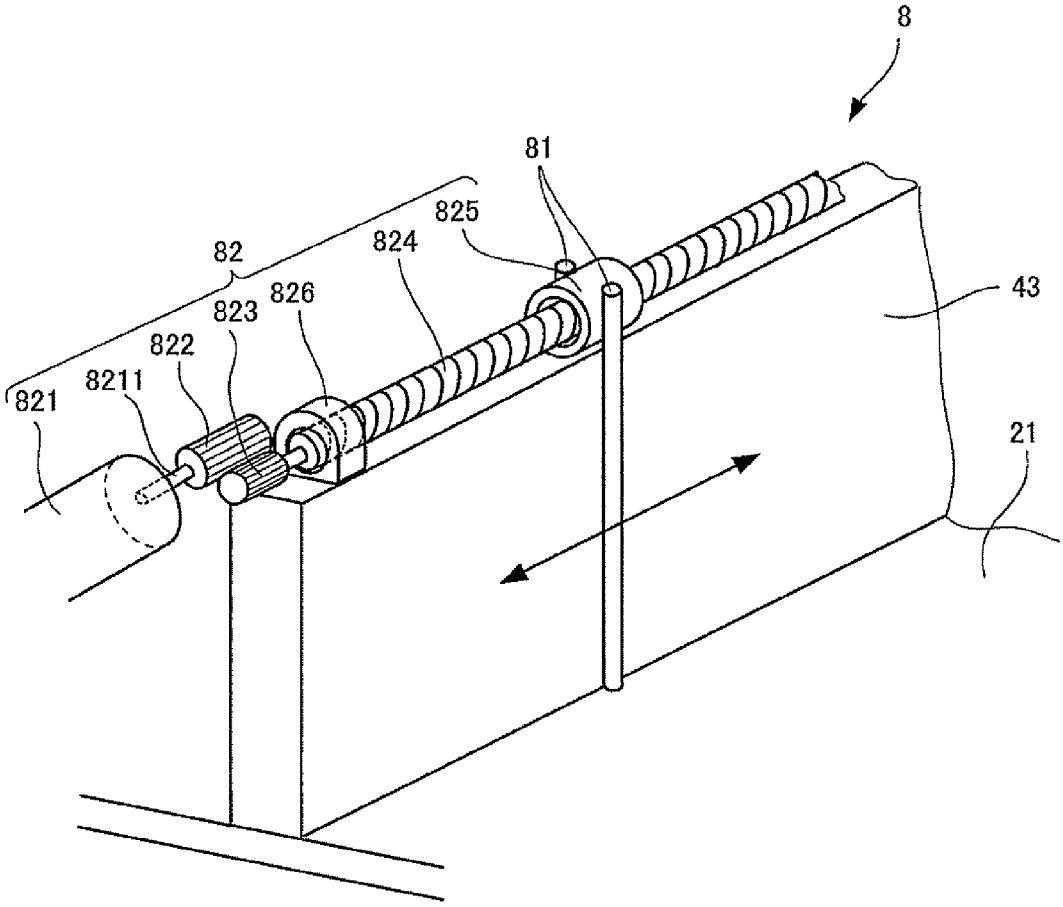
FIG. 10 is an external perspective diagram of a partition portion of a developing device that is a seventh exemplary embodiment.
Figure 11:
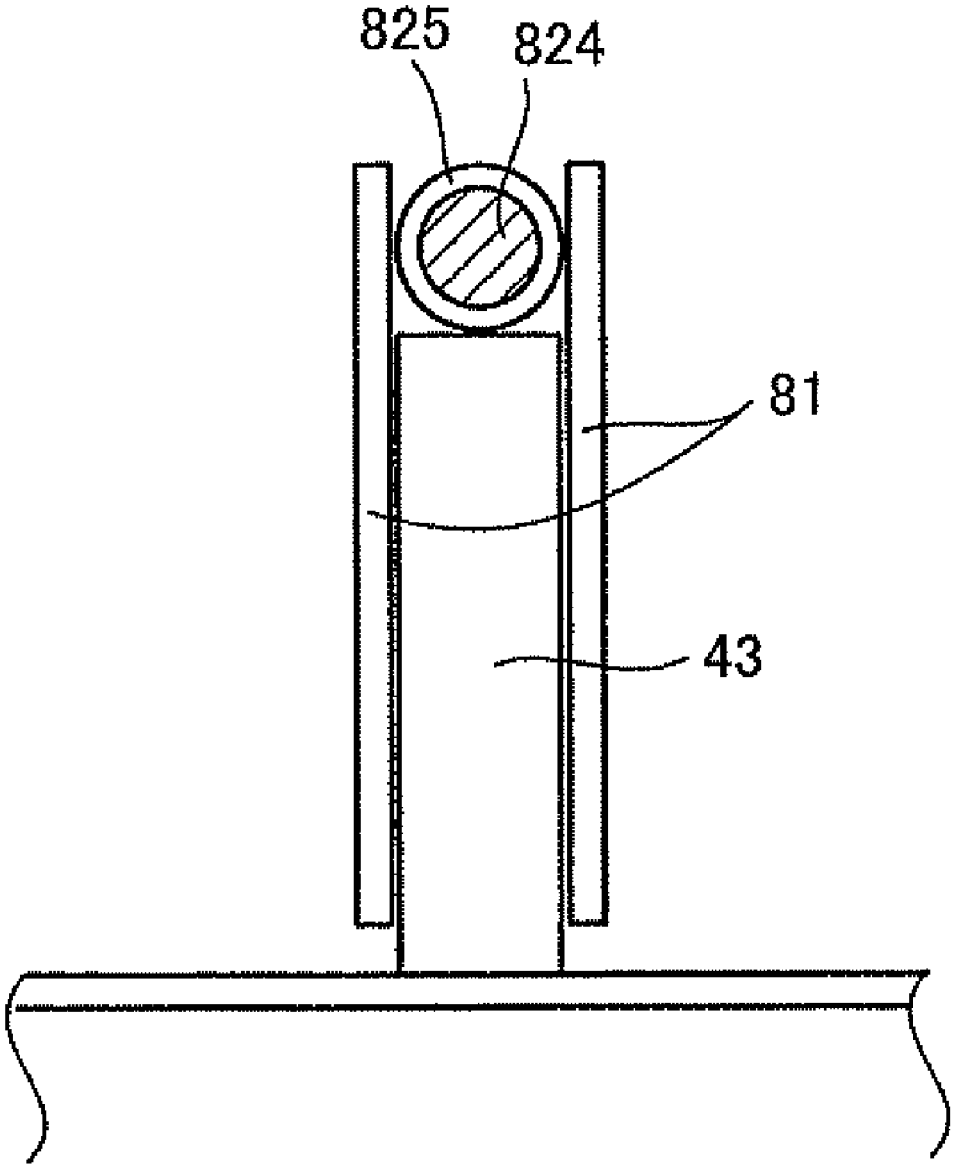
FIG. 11 is a schematic cross-sectional view of the partition portion of the developing device that is the seventh exemplary embodiment.

FIG. 10 is an external perspective view showing a partition portion of a developing device that is the seventh exemplary embodiment, and FIG. 11 is a schematic sectional view of the same.

A developing device 8 shown in FIG. 10 has a container 21 the base of which the partition board 43 also shown in FIG. 6 is fixed to, bars 81 made of resin, and a driving section 82 that moves the bars 81 along the partition board 43.

The driving section 82 has a helical bar 824 with helical gash formed on its surface, a support 826 disposed on a top surface of the partition board 43 for rotatably supporting the helical bar 824, a cylindrical member 825 in which a groove to be engaged with the helical gash of the helical bar 824 is formed on an inner circumference surface thereof, a gear 823 attached to one end of the helical bar 824, a pinion gear 822 to be engaged with the gear 823, and a motor 821 having a rotation shaft 8211 which the pinion gear 822 is attached to.

FIG. 11 shows a state where the helical bar 824 is engaged with the cylindrical member 825, and the bars 81 are disposed to extend along the both surfaces of the partition board 43. With this structure, driving the motor 821 rotates the helical bar 824 and moves the cylindrical member 825 along the helical bar 824. At the same time, the two bars 81 move along the partition board 43. Accordingly, also in the developing device 8, driving the motor 821 as required enables loosening of developer attached to the partition board 43.

Incidentally, a single partition is described as an example of the partition board (section) in each of the exemplary embodiments of the present invention. However, the partition of the present invention may be more than two.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling other skilled in the art to understand the invention for various embodiments and with the various modifications as are suited to the particular use contemplated. It is intended that the scope of the invention be defined by the following claims and their equivalents.

What is claimed is:

1. A developing device comprising:

a container that contains a developer including toner;

a partition that forms a plurality of chambers by partitioning an interior space of the container;

an agitation mechanism that agitates the developer in the interior space and moves the developer between the plurality of chambers;

a transport section that is supplied with the developer from the container, and transports the developer to a surface of an image carrier that carries an electrostatic latent image such that the transported developer is close to or contacts the surface of the image carrier, thereby developing the electrostatic latent image; and a driving mechanism that moves at least the partition; wherein, the partition is formed by a fixed portion and a plurality of movable portions, the plurality of movable portions being provided on both sides of the fixed portion;

the fixed portion being integrated with the container and fixed on a bottom surface of the container;

the plurality of movable portions being configured to swing from the sides of the fixed portion; and the driving mechanism being configured to cause the movable portions to move.

2. The developing device according to claim 1, wherein the driving mechanism moves the partition independently of the container.

3. The developing device according to claim 1, wherein the driving mechanism swings the partition by using a predetermined portion of the partition as an axis.

4. The developing device according to claim 1, wherein the driving mechanism moves the partition together with the container.

5. The developing device according to claim 1, wherein the partition and the container are integrally formed, and the driving mechanism vibrates the partition and the container.

6. The developing device according to claim 1, comprising a housing that encapsulates the partition and the container and has rigidity at least greater than that of the partition, wherein the driving mechanism vibrates the partition and the container inside the housing.

7. The developing device according to claim 1, wherein the partition and the container are integrally formed, and the driving mechanism oscillates the partition and the container around the transport section.

8. A developing device comprising:

a container that contains a developer including toner;

a partition that forms a plurality of chambers by partitioning an interior space of the container;

an agitation mechanism that agitates the developer in the interior space and moves the developer between the plurality of chambers;

a transport section that is supplied with the developer from the container, and transports the developer to a surface of an image carrier that carries an electrostatic latent image such that the transported developer is close to or contacts the surface of the image carrier, thereby developing the electrostatic latent image; and a moving member that moves along the partition; wherein the partition is formed by a fixed portion and movable portions, the movable portions being provided on both sides of the fixed portion;

the fixed portion being integrated with the container and fixed on a bottom surface of the container;

the movable portions being configured to move along the fixed portion; and the driving mechanism being configured to cause the movable portions to move.

9. The developing device according to claim 8, wherein the partition and the container are integrally formed.

10. The developing device according to claim 8, comprising a housing that encapsulates the partition and the container and has rigidity at least greater than that of the partition.

11. An image forming apparatus comprising:

an image carrier that carries an image to be formed on a surface thereof;

a latent image forming section that forms an electrostatic image on the surface of the image carrier; and a developing device that contains developer including toner and forms a toner image by attaching the toner to the electrostatic latent image formed on the surface of the image carrier, the developing device comprising:

a container that contains developer including toner;

a partition that forms a plurality of chambers by partitioning an interior space of the container;

an agitation mechanism that agitates the developer in the interior space and moves the developer between the plurality of chambers;

a transport section that is supplied with the developer from the container, and transports the developer to a surface of an image carrier that carries an electrostatic latent image such that the transported developer is close to or contacts the surface of the image carrier, thereby developing the electrostatic latent image; and a driving mechanism that moves at least the partition; wherein the partition is formed by a fixed portion and a plurality of movable portions, the movable portions being provided on both sides of the fixed portion;

the fixed portion being integrated with the container and fixed on a bottom surface of the container;

the plurality of movable portions being configured to swing along the sides of the fixed portion; and the driving mechanism being configured to cause the plurality of movable portions to move.

12. An image forming apparatus comprising:

an image carrier that carries an image to be formed on a surface thereof;

a latent image forming section that forms an electrostatic image on the surface of the image carrier; and a developing device that contains developer including toner and forms a toner image by attaching the toner to the electrostatic latent image formed on the surface of the image carrier, the developing device comprising:

a container that contains developer including toner;

a partition that forms a plurality of chambers by partitioning an interior space of the container;

an agitation mechanism that agitates the developer in the interior space and moves the developer between the plurality of chambers;

a transport section that is supplied with the developer from the container, and transports the developer to a surface of an image carrier that carries an electrostatic latent image such that the transported developer is close to or contacts the surface of the image carrier, thereby developing the electrostatic latent image; and a moving member that moves along the partition; wherein the partition is formed by a fixed portion and movable portions, the movable portions being provided on both sides of the fixed portion;

the fixed portion being integrated with the container and fixed on a bottom surface of the container;

the movable portions being configured to move along the fixed portion; and the driving mechanism being configured to cause the movable portions to move.

13. A developing device comprising:

a container that contains a developer including toner and magnetic carrier;

a partition that extends in a plane perpendicular to a first direction and that forms a first chamber and a second chamber, which are arranged in the first direction, by partitioning an interior space of the container or a portion of the interior space into two compartments;

a first agitation member that is disposed in the first chamber, has a spiral shape which extends in a second direction perpendicular to the first direction, and moves the developer in the first chamber in a movement direction along the second direction while agitating the developer in the first chamber and supplying the moved developer from the first chamber to the second chamber near one end of the partition in the second direction, by rotating around a center axis of the spiral shape of the first agitation member;

a second agitation member that is disposed in the second chamber, has a spiral shape which extends in the second direction, and moves the developer in the second chamber in an opposite direction to the movement direction of the developer in the first chamber while agitating the developer in the second chamber and supplying the moved developer from the second chamber to the first chamber near an end of the partition opposite the one end of the partition in the second direction, by rotating around a center axis of the spiral shape of the second agitation member;

a transport section that is disposed close to the first chamber, has a roll shape which extends in the second direction, and transports the developer, which is supplied from the first chamber to a surface of the transport section, to a surface of an image carrier that carries an electrostatic latent image such that the transported developer is close to or contacts the surface of the image carrier to develop the electrostatic latent image, by rotating around a center axis of the roll shape of the transport section; and a driving mechanism that moves the partition, wherein the partition includes a fixed portion that extends in a plane perpendicular to the first direction and fixed on the container, and a driven portion that is rotatable around a partition axis which is disposed closed to a surface of the fixed portion facing the first agitation member or the second agitation member and which extends in the second direction passing through an end portion of the driven portion, and the driving mechanism rotates the driven portion around the partition axis between a closed state, in which a whole of the driven portion substantially covers the surface of the fixed portion, and a open state in which a remaining portion of the driven portion except the end portion is placed away from the fixed portion.

14. A developing device comprising:

a container that contains a developer including toner and magnetic carrier;

a partition that extends in a plane perpendicular to a first direction and that forms a first chamber and a second chamber, which are arranged in the first direction, by partitioning an interior space of the container or a portion of the interior space into two compartments;

a first agitation member that is disposed in the first chamber, has a spiral shape which extends in a second direction perpendicular to the first direction, and moves the developer in the first chamber in a movement direction along the second direction while agitating the developer in the first chamber and supplying the moved developer from the first chamber to the second chamber near one end of the partition in the second direction, by rotating around a center axis of the spiral shape of the first agitation member;

a second agitation member that is disposed in the second chamber, has a spiral shape which extends in the second direction, and moves the developer in the second chamber in an opposite direction to the movement direction of the developer in the first chamber while agitating the developer in the second chamber and supplying the moved developer from the second chamber to the first chamber near an end of the partition opposite the one end of the partition in the second direction, by rotating around a center axis of the spiral shape of the second agitation member;

a transport section that is disposed close to the first chamber, has a roll shape which extends in the second direction, and transports the developer, which is supplied from the first chamber to a surface of the transport section, to a surface of an image carrier that carries an electrostatic latent image such that the transported developer is close to or contacts the surface of the image carrier to develop the electrostatic latent image, by rotating around a center axis of the roll shape of the transport section; and a driving mechanism that moves the partition, wherein the container has a lining layer made of hard-rubber on an inner surface of the container facing the contained developer, the partition is fixed on the container, made of hard-rubber, and connected to the lining layer of the container, and the driving mechanism has an eccentric motor that is rotated while being in contact with an outer surface of the container opposite to the inner surface of the container, and the driving mechanism vibrates the partition by rotating the eccentric motor to vibrate the container.

15. A developing device comprising:

a container that contains a developer including toner and magnetic carrier;

a partition that extends in a plane perpendicular to a first direction and that forms a first chamber and a second chamber, which are arranged in the first direction, by partitioning an interior space of the container or a portion of the interior space into two compartments;

a first agitation member that is disposed in the first chamber, has a spiral shape which extends in a second direction perpendicular to the first direction, and moves the developer in the first chamber in a movement direction along the second direction while agitating the developer in the first chamber and supplying the moved developer from the first chamber to the second chamber near one end of the partition in the second direction, by rotating around a center axis of the spiral shape of the first agitation member;

a second agitation member that is disposed in the second chamber, has a spiral shape which extends in the second direction, and moves the developer in the second chamber in an opposite direction to the movement direction of the developer in the first chamber while agitating the developer in the second chamber and supplying the moved developer from the second chamber to the first chamber near an end of the partition opposite the one end of the partition in the second direction, by rotating around a center axis of the spiral shape of the second agitation member;

a transport section that is disposed close to the first chamber, has a roll shape which extends in the second direction, and transports the developer, which is supplied from the first chamber to a surface of the transport section, to a surface of an image carrier that carries an electrostatic latent image such that the transported developer is close to or contacts the surface of the image carrier to develop the electrostatic latent image, by rotating around a center axis of the roll shape of the transport section;

a driving mechanism that moves the partition; and a housing that is made of resin and encapsulates the container, wherein the container is made of hard-rubber, the partition is fixed on the container, and the driving mechanism has an eccentric motor that is rotated while being in contact with both an outer surface of the container opposite to an inner surface of the container facing the contained developer, and an inner surface of the housing facing the encapsulated container, and the driving mechanism vibrates the partition by rotating the eccentric motor to vibrate the container.

16. A developing device comprising:

a container that contains a developer including toner and magnetic carrier;

a partition that extends in a plane perpendicular to a first direction and that forms a first chamber and a second chamber, which are arranged in the first direction, by partitioning an interior space of the container or a portion of the interior space into two compartments;

a first agitation member that is disposed in the first chamber, has a spiral shape which extends in a second direction perpendicular to the first direction, and moves the developer in the first chamber in a movement direction along the second direction while agitating the developer in the first chamber and supplying the moved developer from the first chamber to the second chamber near one end of the partition in the second direction, by rotating around a center axis of the spiral shape of the first agitation member;

a second agitation member that is disposed in the second chamber, has a spiral shape which extends in the second direction, and moves the developer in the second chamber in an opposite direction to the movement direction of the developer in the first chamber while agitating the developer in the second chamber and supplying the moved developer from the second chamber to the first chamber near an end of the partition opposite the one end of the partition in the second direction, by rotating around a center axis of the spiral shape of the second agitation member;

a transport section that is disposed close to the first chamber, has a roll shape which extends in the second direction, and transports the developer, which is supplied from the first chamber to a surface of the transport section, to a surface of an image carrier that carries an electrostatic latent image such that the transported developer is close to or contacts the surface of the image carrier to develop the electrostatic latent image, by rotating around a center axis of the roll shape of the transport section; and a driving mechanism that moves the partition, wherein the partition is fixed on the container, and the driving mechanism has a cam that is rotated around a cam rotation axis extending in the second direction while being in contact with an outer surface of the container opposite to an inner surface of the container facing the contained developer, and the driving mechanism swings the partition by rotating, while keeping the transport section at a predetermined position without moving the transport section, the cam around the cam rotation axis to swing the container around the transport section in a plane perpendicular to the second direction.

17. A developing device comprising:

a container that contains a developer including toner and magnetic carrier;

a partition that extends in a plane perpendicular to a first direction and that forms a first chamber and a second chamber, which are arranged in the first direction, by partitioning an interior space of the container or a portion of the interior space into two compartments;

a first agitation member that is disposed in the first chamber, has a spiral shape which extends in a second direction perpendicular to the first direction, and moves the developer in the first chamber in a movement direction along the second direction while agitating the developer in the first chamber and supplying the moved developer from the first chamber to the second chamber near one end of the partition in the second direction, by rotating around a center axis of the spiral shape of the first agitation member;

a second agitation member that is disposed in the second chamber, has a spiral shape which extends in the second direction, and moves the developer in the second chamber in an opposite direction to the movement direction of the developer in the first chamber while agitating the developer in the second chamber and supplying the moved developer from the second chamber to the first chamber near an end of the partition opposite the one end of the partition in the second direction, by rotating around a center axis of the spiral shape of the second agitation member;

a transport section that is disposed close to the first chamber, has a roll shape which extends in the second direction, and transports the developer, which is supplied from the first chamber to a surface of the transport section, to a surface of an image carrier that carries an electrostatic latent image such that the transported developer is close to or contacts the surface of the image carrier to develop the electrostatic latent image, by rotating around a center axis of the roll shape of the transport section; and a moving member that extends along a surface of the partition facing the first agitation member or the second agitation member, close to or in contact with the surface of the partition, and moves in the second direction along the surface of the partition.

18. An image forming apparatus comprising:

an image carrier that carries an image to be formed on a surface thereof;

a latent image forming section that forms an electrostatic image on the surface of the image carrier; and a developing device that contains developer including toner and forms a toner image by attaching the toner to the electrostatic latent image formed on the surface of the image carrier, the developing device comprising:

a container that contains a developer including toner and magnetic carrier;

a partition that extends in a plane perpendicular to a first direction and that forms a first chamber and a second chamber, which are arranged in the first direction, by partitioning an interior space of the container or a portion of the interior space into two compartments;

a first agitation member that is disposed in the first chamber, has a spiral shape which extends in a second direction perpendicular to the first direction, and moves the developer in the first chamber in a movement direction along the second direction while agitating the developer in the first chamber and supplying the moved developer from the first chamber to the second chamber near one end of the partition in the second direction, by rotating around a center axis of the spiral shape of the first agitation member;

a second agitation member that is disposed in the second chamber, has a spiral shape which extends in the second direction, and moves the developer in the second chamber in an opposite direction to the movement direction of the developer in the first chamber while agitating the developer in the second chamber and supplying the moved developer from the second chamber to the first chamber near an end of the partition opposite the one end of the partition in the second direction, by rotating around a center axis of the spiral shape of the second agitation member;

a transport section that is disposed close to the first chamber, has a roll shape which extends in the second direction, and transports the developer, which is supplied from the first chamber to a surface of the transport section, to a surface of an image carrier that carries an electrostatic latent image such that the transported developer is close to or contacts the surface of the image carrier to develop the electrostatic latent image, by rotating around a center axis of the roll shape of the transport section; and a driving mechanism that moves the partition, wherein the partition includes a fixed portion that extends in a plane perpendicular to the first direction and fixed on the container, and a driven portion that is rotatable around a partition axis which is disposed closed to a surface of the fixed portion facing the first agitation member or the second agitation member and which extends in the second direction passing through an end portion of the driven portion, and the driving mechanism rotates the driven portion around the partition axis between a closed state, in which a whole of the driven portion substantially covers the surface of the fixed portion, and a open state in which a remaining portion of the driven portion except the end portion is placed away from the fixed portion.

19. An image forming apparatus comprising:

an image carrier that carries an image to be formed on a surface thereof;

a latent image forming section that forms an electrostatic image on the surface of the image carrier; and a developing device that contains developer including toner and forms a toner image by attaching the toner to the electrostatic latent image formed on the surface of the image carrier, the developing device comprising:

a container that contains a developer including toner and magnetic carrier;

a partition that extends in a plane perpendicular to a first direction and that forms a first chamber and a second chamber, which are arranged in the first direction, by partitioning an interior space of the container or a portion of the interior space into two compartments;

a first agitation member that is disposed in the first chamber, has a spiral shape which extends in a second direction perpendicular to the first direction, and moves the developer in the first chamber in a movement direction along the second direction while agitating the developer in the first chamber and supplying the moved developer from the first chamber to the second chamber near one end of the partition in the second direction, by rotating around a center axis of the spiral shape of the first agitation member;

a second agitation member that is disposed in the second chamber, has a spiral shape which extends in the second direction, and moves the developer in the second chamber in an opposite direction to the movement direction of the developer in the first chamber while agitating the developer in the second chamber and supplying the moved developer from the second chamber to the first chamber near an end of the partition opposite the one end of the partition in the second direction, by rotating around a center axis of the spiral shape of the second agitation member;

a transport section that is disposed close to the first chamber, has a roll shape which extends in the second direction, and transports the developer, which is supplied from the first chamber to a surface of the transport section, to a surface of an image carrier that carries an electrostatic latent image such that the transported developer is close to or contacts the surface of the image carrier to develop the electrostatic latent image, by rotating around a center axis of the roll shape of the transport section; and a moving member that extends along a surface of the partition facing the first agitation member or the second agitation member, close to or in contact with the surface of the partition, and moves in the second direction along the surface of the partition.

20. The developing device according to claim 1, further comprising a plurality of shafts, each shaft being configured so that each of the plurality of movable portions pivots around a respective shaft, each shaft being distinct from other shafts.

21. The developing device according to claim 8, further comprising a plurality of shafts, each shaft being configured so that each of the plurality of movable portions pivots around a respective shaft, each shaft being distinct from other shafts.

22. The developing device according to claim 11, further comprising a plurality of shafts, each shaft being configured so that each of the plurality of movable portions pivots around a respective shaft, each shaft being distinct from other shafts.

23. The developing device according to claim 12, further comprising a plurality of shafts, each shaft being configured so that each of the plurality of movable portions pivots around a respective shaft, each shaft being distinct from other shafts.

* * * * *